United States Patent [19]

Caillat

[11] Patent Number: 4,639,201

[45] Date of Patent: Jan. 27, 1987

[54] SCROLL-TYPE MACHINE WITH VARIABLE WRAP THICKNESS

[75] Inventor: Jean-Luc Caillat, Dublin, Ohio

[73] Assignee: Copeland Corporation, Sidney, Ohio

[21] Appl. No.: 775,154

[22] Filed: Sep. 12, 1985

[51] Int. Cl.[4] ..... F01C 1/04; F01C 21/16; F04C 18/04; F04C 29/10

[52] U.S. Cl. ..... 418/55; 418/57

[58] Field of Search ..... 418/55, 57, 59

[56] References Cited

U.S. PATENT DOCUMENTS

| | | | |
|---|---|---|---|
| 1,376,291 | 4/1921 | Rolkerr | 418/55 |
| 2,324,168 | 7/1943 | Montelius | 418/55 |
| 4,082,484 | 4/1978 | McCullough | 418/57 |
| 4,178,143 | 12/1979 | Thelen et al. | 418/57 |
| 4,551,078 | 11/1985 | Hiraga | 418/57 |

*Primary Examiner*—John J. Vrablik

*Attorney, Agent, or Firm*—Harness, Dickey & Pierce

[57] ABSTRACT

A scroll machine is disclosed in which the wrap of one of the scroll members is formed in two pieces which can be moved with respect to one another to change the effective thickness of the wrap and hence the displacement of the machine.

29 Claims, 7 Drawing Figures

SCROLL-TYPE MACHINE WITH VARIABLE WRAP THICKNESS

BACKGROUND AND SUMMARY

The present invention relates to fluid displacement apparatus and more particularly to a scroll-type machine especially adapted for compressing gaseous fluids and having means for varying the displacement and hence capacity thereof.

A class of machines exists in the art generally known as "scroll" apparatus for the displacement of various types of fluids. Such apparatus may be configured as an expander, a displacement engine, a pump, a compressor, etc. The present invention, however, is particularly applicable to compressors, and therefore for purposes of illustration is disclosed in the form of a gaseous fluid compressor.

Generally speaking, a scroll apparatus comprises two spiral scroll wraps of similar configuration each mounted on a separate end plate to define a scroll member. The two scroll members are interfitted together with one of the scroll wraps being rotationally displaced 180 degrees from the other. The apparatus operates by orbiting one scroll member (the "orbiting" scroll member) with respect to the other scroll member (the "fixed" scroll member) to make moving line contacts between the flanks of the respective wraps defining moving isolated crescent-shaped pockets or chambers of fluid. The spirals are commonly formed as involutes of a circle, and ideally there is no relative rotation between the scroll members during operation, i.e., the motion is purely curvilinear translation (i.e. no rotation of any line in the body). The fluid pockets carry the fluid to be handled from a first zone in the scroll apparatus where a fluid inlet is provided, to a second zone in the apparatus where a fluid outlet is provided. The volume of a sealed pocket progressively changes as it moves from the first zone to the second zone. At any one instant in time there will be at least one pair of sealed pockets, and when there are several pairs of sealed pockets at one time, each pair will have different volumes. In a compressor the second zone is at a higher pressure than the first zone and is physically located centrally in the apparatus, the first zone being located at the outer periphery of the apparatus.

Two types of contacts define the fluid pockets formed between the scroll members: axially extending tangential line contacts between the spiral faces of the wraps caused by radial forces ("flank sealing"), and area contacts caused by axial forces between the plane edge surfaces (the "tips") of each wrap and the opposite end plate ("tip Sealing"). For high efficiency, good sealing must be achieved for both types of contacts. In a conventional scroll compressor (i.e. one in which the wraps are involutes of a circle) good flank sealing requires that there be no relative rotation between the scrolls.

The concept of a scroll-type apparatus has been known for some time and has been recognized as having distinct advantages. For example, scroll machines have high isentropic and volumetric efficiency, and hence are relatively small and lightweight for a given capacity. They are quieter and more vibration free than many compressors because they do not use large reciprocating parts (e.g. pistons, connecting rods, etc.), and because all fluid flow is in one direction with simultaneous compression in plural opposed pockets there are less pressure-created vibrations. Such machines also tend to have high reliability and durability because of the relative few moving parts utilized, the relative low velocity of movement between the scrolls, and an inherent forgiveness to fluid contamination.

The capacity, or displacement per revolution, of a scroll machine is in part a function of the orbiting radius of the orbiting scroll, which in turn is in part a function (inverse) of wrap thickness; i.e., the greater the wrap thickness the smaller the orbiting radius and capacity of the machine, all other things being equal. The present invention resides in the discovery of a relatively simple technique for varying wrap thickness an thereby varying the displacement or capacity of the machine, even while the machine is operating. The machine of the present invention is therefore ideally suited for applications where capacity modulation is desirable. Furhermore, the machine of the present ivnention is capable of providing infinitely variable modulation, from almost zero displacement to full displacement, while maintaining full displacement efficiency throughout the entire displacement range. The present machine offers the additional advantage that friction and wear are reduced as capacity is reduced, and yet full lubrication is provided at all displacements.

Additional advantages and features of the present invention will become apparent from the subsequent description and the appended claims taken in conjunction with the accompanying drawings.

DESCRIPTION OF THE PREFERRED EMBODIMENTS

Figure 1:
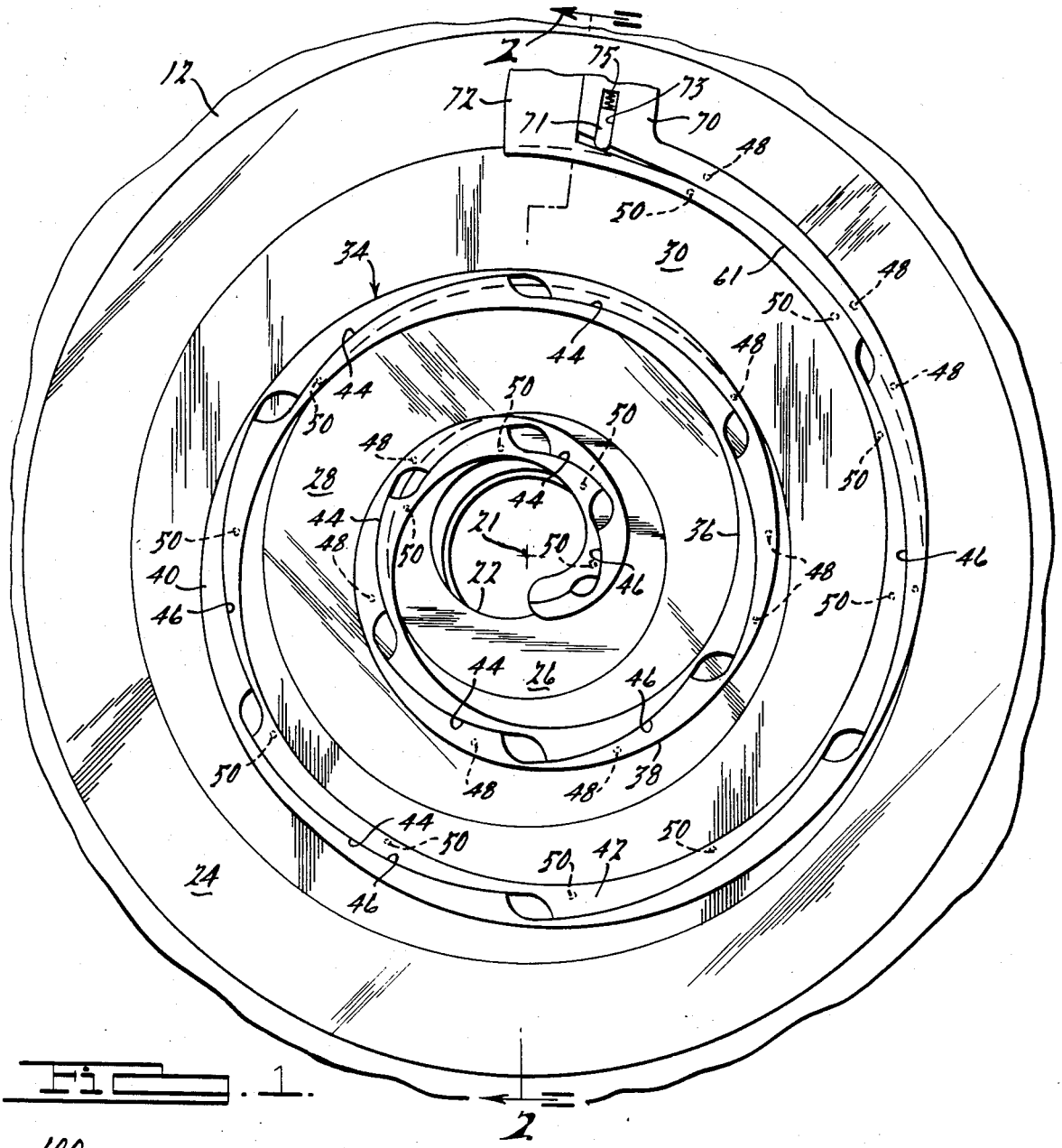
FIG. 1 is a top plan view of the operable portion of a fixed scroll member illustrating an embodiment of the present invention in its maximum displacement condition.

With reference to the drawings there is illustrated a fixed scroll member 10 for a conventional scroll-type compressor. Scroll member 10 comprises an end plate 12 having a generally flat annular support surface 13 thereon, an outer shoulder 14 having a generally circular cylindrical concave surface 16 thereon defining the outer periphery of support surface 12 and an inner shoulder 18 having a generally circular cylindrical convex surface 20 thereon defining the inner periphery of support surface 12. Surfaces 16 and 20 each have a center of curvature lying on the same axis, indicated at 21. A generally circular discharge opening 22 extends through the center portion of end plate 12 within the confines of inner shoulder 18.

An annular outer mounting ring 24 is slidingly supported on support surface 13, ring 24 being generally rectangular in cross-section and having inner and outer circular cylindrical peripheral surfaces concentric with one another and axis 21. The outer peripheral surface of outer mounting ring 24 is in guided sliding relationship with said concave surface 16. One face of ring 24 slidingly engages support surface 13 and the opposite face thereof, indicated at 25, lies in a plane parallel to the plane of support surface 13.

An annular inner mounting ring 26 is also supported on support surface 13. Inner mounting ring has inner and outer circular cylindrical surfaces concentric with each other and axis 21, with the inner peripheral surface being disposed in guided sliding relationship with concave surface 16. One face of ring 26 slidingly engages support surface 13 and the opposite face 27 thereof lies in the same plane as face 25.

A first intermediate annular mounting ring 28 is also supported on support surface 13, ring 28 also being generally rectangular in cross-section and having inner and outer circular cylindrical peripheral surfaces concentric with one another and axis 21. the inner peripheral surface of ring 28 is in guided sliding relationship with the outer peripheral surface of adjacent inwardly disposed ring 26. One face of ring 28 slidingly engages support surface 13 with opposite face 29 thereof lying in the same plane as faces 25 and 27.

A second intermediate annular mounting ring 30 is also supported on support surface 13, and is also generally rectangular in cross-section having inner and outer circular cylindrical peripheral surfaces concentric with one another and axis 21. The inner peripheral surface of ring 30 is in guided sliding relationship with the outer peripheral surface of adjacent inwardly disposed ring 28 and the outer peripheral surface of intermediate ring 30 is in guided sliding relationship with the inner peripheral surface of the adjacent outwardly disposed mounting ring 24. One face of ring 30 slidingly engages support surface 13 with the opposite face 31 thereof lying in the same plane as faces 25, 27 and 29.

Elastomeric fluid seals 32 are located at the intersection of support surface 13 and the interface between each pair of adjacent mounting rings, and at the intersection of support surface 13 and the interface between inner mounting ring 26 and convex surface 20. Seals 32 may be of the conventional O-ring type disposed in appropriately configured annular grooves or recesses.

A spiral wrap, generally indicated at 34, is disposed on faces 25, 27, 29 and 31 of the mounting rings. Wrap 34 has generally parallel inner and outer flank surfaces 36 and 38, respectively, and is split longitudinally into an outer wrap section 40 having outer flank surface 38 and an inner wrap section 42 having inner flank surface 36. Flank surfaces 36 and 38 preferably have the profile of an involute of a circle. Wrap sections 40 and 42 are preferably of the same thickness to maximize strength, however they need not be. Inner wrap section 42 has an outer surface comprising a plurality of interconnected arcuate portions 44, each of the arcuate portions being generally circular cylindrical in configuration and having a center of curvature lying on axis 21 (preferably also the axis of the generating circle for the wrap profiles). Outer wrap section 40 has an inner surface comprising a plurality of interconnected arcuate portions 46, each of which is generally circular cylindrical in configuration and has a center of curvature lying on axis 21. Arcuate portions 44 on inner wrap section 42 slidingly engage arcuate portions 46 on outer wrap section 40, whereby rotation of the wrap sections relative to one another in one direction will cause flank surfaces 36 and 38 to move away from one another and in the opposite direction will cause said flank surfaces 36 and 38 to move toward one another, thereby changing the effective thickness of the spiral wrap.

Figure 3:
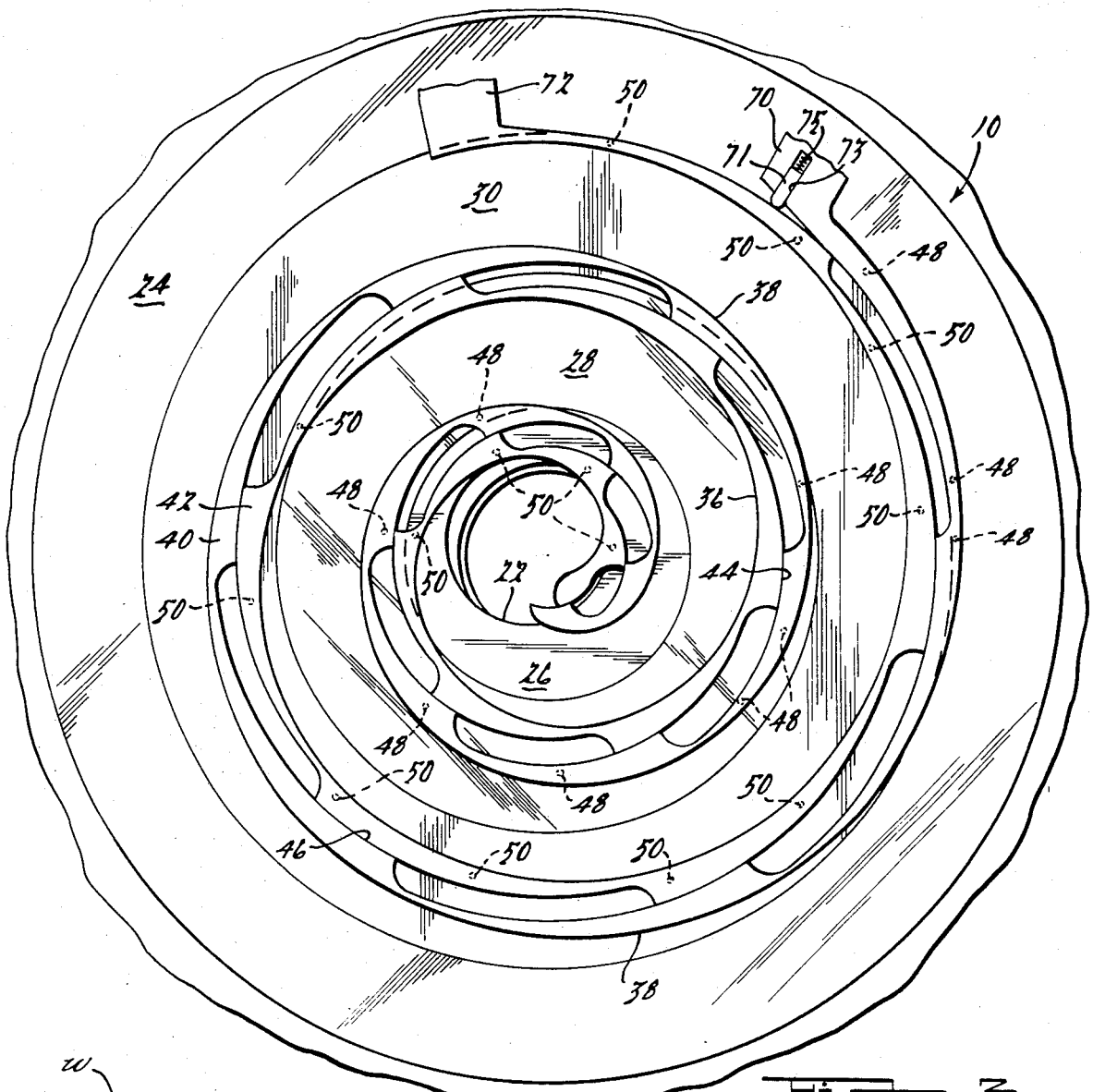
FIG. 3 is a view similar to FIG. 1 but showing the apparatus in its minimum displacement condition.
Figure 4:
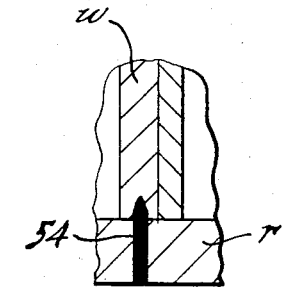
FIG. 4 is a fragmentary sectional view illustrating one technique for affixing parts of the apparatus to one another.
Figure 5:
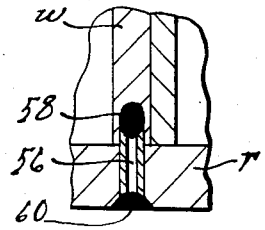
FIG. 5 is a view similar to FIG. 4 showing an alternative technique for affixing parts to one another.

Outer wrap section 40 is affixed to outer mounting ring 24 and to every second mounting ring disposed radially inwardly thereof (i.e. ring 28) at points 48 (FIG. 3); and inner wrap section 42 is affixed to the mounting ring immmediately radially inwardly of outer mounting ring 24 (namely, ring 30) and to every second mounting ring disposed radially inwardly thereof (i.e. ring 26) at points 50 (FIG. 3). The manner of connecting the wrap sections to the rings at points 48 and 50 may be in accordance with any known principles. For example, in FIG. 4 there is illustrated a technique in which the wrap section w is affixed to the ring by means of a weld 54 which is made through the ring r into the wrap using known techniques. An alternative technique is illustrated in FIG. 5, wrap w is affixed to ring r by means of a tubular sleeve 56 disposed in a hole which extends through ring r into wrap w and is thereafter welded in place as at 58 and 60. As many points of connection as are necessary to achieve the desired strength may be utilized. Furthermore, as many rings as are necessary for the desired wrap support may be used. It should be noted that insofar as radial forces are concerned, the wrap sections tend to support one another in all thickness conditions.

In order to provide a maximum amount of strength at the outer ends of the wrap sections, it is preferable that the bearing surfaces on the wrap sections in this area coincide with the O.D. of ring 30 (or the I.D. of ring 24), as indicated at 61 in FIG. 1. this permits both wrap sections to be anchored to rings in this area. Although it is not shown in the embodiment illustrated, it is also believed preferable to arrange the rings so that the outer section of the wrap at the inner end thereof is also affixed to a ring. There is no requirement that the rings be of equal width and the overall arrangement of ring widths and numbers can be tailored in any particular application to provide for maximum support of the scroll wrap sections.

The wrap sections of the present invention are susceptible of actuation by any suitable type of arrangement. Furthermore, it is not necessary to actuate the wrap sections by moving their respective ends; it may be just as feasible to rotate alternate rings with respect to one another. It is also possible to construct the apparatus with one wrap section fixed and only one section actuated; however, this will result in a loss of sealing (i.e. there will be unloading of the wrap flanks), unless the other scroll member (i.e. the orbiting scroll) is also rotated in the same direction in an amount equal to one-half the angular displacement of the single wrap section. It is preferable from the standpoint of achieving uniform sealing (i.e. no side unloading) to have each of the wrap sections move equidistant in opposite directions to effect the desired wrap thickness change.

Figure 6:
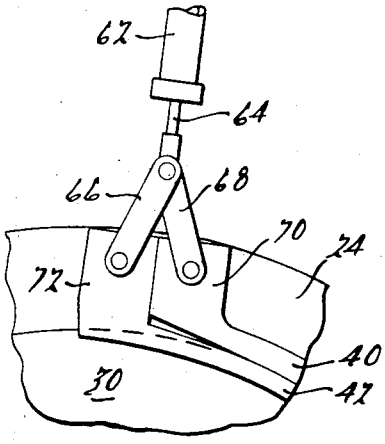
FIG. 6 is diagrammatic fragmentary top-elevational view illustrating one actuating means embodiment.
Figure 7:
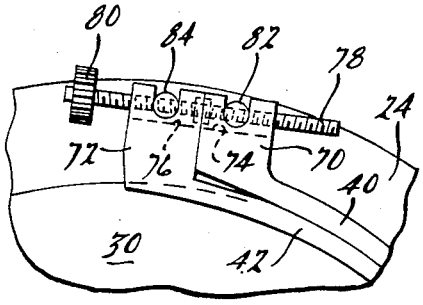
FIG. 7 is a view similar to FIG. 6 illustrating an alternative actuating means embodiment.

In FIGS. 6 and 7 there are illustrated alternative techniques for causing relative rotation between each of the wrap sections 40 and 42 on alternate rings. For example, in FIG. 6 there is illustrated a fluid motor 62 having an actuating rod 64 pivotally connected to a pair of links 66 and 68 the opposite ends of which are pivotally connected to the outer ends 70 and 72 of wraps 40 and 42 respectively. As can be visualized, actuation of motor 62 will cause rod 64 to extend to thereby cause links 66 and 68 to urge ends 70 and 72 apart, in turn causing relative rotation between the wrap sections and a corresponding increase in the effective thickness of the overall wrap. Actuation in the reverse direction causes relative rotation in the opposite direction with a corresponding decrease in the effective thickness of the overall wrap.

An alternative technique is illustrated in FIG. 7, wherein the radially outer faces of wrap section ends 70 and 72 are provided with aligned slots 74 and 76, respectively, in which is disposed a threaded rod 78 having a driven pinion 80 at one end thereof. Threaded rod 78 threadably engages drive nuts 82 and 84 with threads of opposite hand, respectively, the latter being disposed in notches of the shape illustrated so that rotation of rod 78 (by a stepper motor or the like driving pinion 80) causes nuts 82 and 84 to separate and thereby cause relative rotation of the wrap sections, which in turn causes the effective thickness of the wrap to increase. Rotation of threaded rod in the opposite direction causes the opposite action, as can be readily visualized.

Figure 2:
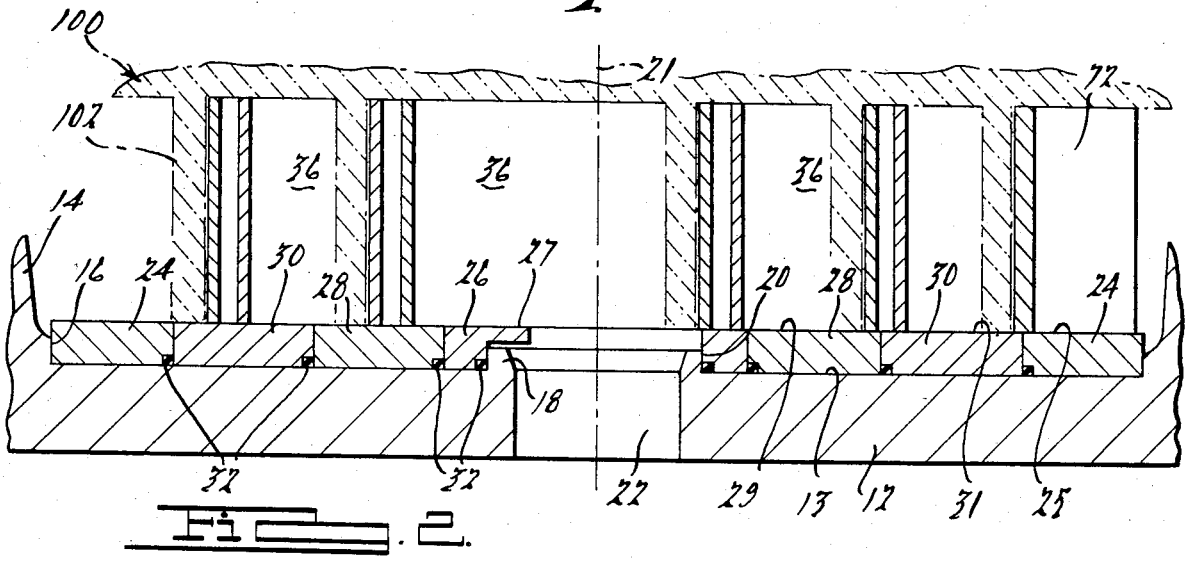
FIG. 2 is a sectional view taken substantially along the line 2—2 in FIG. 1, but also showing the orbiting scroll member in phantom.

The orbiting scroll member, shown in FIG. 2 in phantom at 100 with wraps 102, with which fixed scroll member 10 of the present invention is adapted to interface, may be of conventional construction and may be driven in a circular orbit in the standard manner using any known type of radially compliant drive; for example, such as that disclosed in copending application Ser. No. 471,743, filed Mar. 3, 1983, the disclosure of which is hereby incorporated herein by reference. Radial compliance is preferred to insure that the orbiting wrap will seal against the fixed wrap in all thickness conditions thereof (the slight clearance shown in FIG. 2 is for clarity of illustration only, and would not normally be present in an actual embodiment of the invention). As the capacity of the machine is reduced and the orbiting radius correspondingly decreases, there is also a decrease in the centrifugal force which aids in flank sealing. If it is desired to prevent unloading of the wraps at very low displacements, the radially compliant drive can be provided with means to limit the lower bound of crank throw to prevent unloading of the orbiting scroll at minimal displacements.

The thickness of mating orbital wrap 102 is preferably less than or equal to the total thickness of the fixed wrap when in its minimum thickness. This range is believed to result in minimum leakage.

It is generally not necessary to seal the leakage path between the two wrap sections in the area of the center of the machine. If any such sealing is needed it is believed to be satisfactory to merely seal the volume between the wrap sections adjacent the outer end of the wraps. This may be easily accomplished, for example, by providing in wrap end 70 a sliding vane 71 disposed in slot 73 and having a rounded end biased into sealing engagement with wrap section 42 by a compression spring 75, thereby blocking the flow of fluid from the discharge area of the machine through the gap between the wrap sections and out into the suction area of the machine. In such an arrangement the volume between the wrap sections out to vane 71 merely becomes a part of the discharge or central volume. The vane seal is not shown in FIGS. 6 and 7 for purposes of simplicity. On relatively low pressure ratio machines no such seal may be necessary because the leakage path is so small and tortuous that very little leakage would actually occur. In very high pressure ratio machines, however, the leakage could become significant an the seal may become desirable. In ultra-optical applications the standing vane seal can be provided in the center of the machine adjacent the inner end of the wrap, providing the wrap is of sufficient size to accommodate such a seal.

The split wrap arrangement of the present invention is applicable to other types of scroll machines, and is shown herein embodied in a compressor for exemplary purposes only. The operation of a scroll machine incorporating the principles of the present invention is idential in all respects to the operation of conventional scroll machines, with the exception that the fixed wrap width may be altered for capacity modulation purposes. Because a reduction in capacity of the present machine results in the reduction of the orbiting radius, there is less friction and wear of the respective parts of the machine, thus improving reliability, life and promoting high efficiency. This is not the case in machines which are throttles or ported to modulate capacity. In addition, since the machine always operates at full speed there is enhances lubrication throughout the entire range of capacity modulation by virtue of the fact that the oil pump is always delivering maximum output (assuming it is the type of compressor which has an internal oil pump).

If desired, the split wrap concept of the present invention can be applied to the orbiting scroll member rather than the fixed scroll member; however, it is believed that such an arrangement would probably be unnecessarily complicated as compared to the embodiment illustrated.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

What is claimed is:

1. A scroll member for a scroll-type machine, comprising:

an end plate;

a spiral wrap affixed to said end plate, said wrap having a radially outer wrap section having an outer flank surface and a separate radially inner wrap section having an inner flank surface; and actuating means for moving one wrap section with respect to the other wrap section to vary the space between said inner and outer flank surfaces and thereby change the effective thickness of said wrap.

2. A scroll member as claimed in claim 1, wherein said wrap sections are moved by relative rotational movement.

3. A scroll member as claimed in claim 2, wherein said rotational movement is about a common axis.

4. A scroll member as claimed in claim 3, wherein said inner flank surface has the profile of the involute of a circle and said outer flank surface has the profile of the involute of a circle.

5. A scroll member as claimed in claim 4, wherein said circles are of the same diameter.

6. A scroll member as claimed in claim 4, wherein said common axis passes through the centers of said circles.

7. A scroll member as claimed in claim 1, wherein said wrap sections slidingly engage one another along a plurality of mating bearing surfaces on each of said wrap sections.

8. A scroll member as claimed in claim 7, wherein each of said bearing surfaces intersects a plane parallel to said end plate along a circle.

9. A scroll member as claimed in claim 8, wherein each of said bearing surfaces is circular cylindrical in configuration.

10. A scroll member as claimed in claim 8, wherein all of said bearing surfaces have a common axis of curvature.

11. A scroll member as claimed in claim 10, wherein said inner flank surface has the profile of the involute of a circle and said outer flank surface has the profile of the involute of a circle.

12. A scroll member as claimed in claim 11, wherein said circles are of the same diameter.

13. A scroll member as claimed in claim 12, wherein said common axis of curvature passes through the centers of said circles.

14. A scroll member as claimed in claim 1, further comprising a plurality of nested annular concentric rings mounted on said end plate for rotational movement with respect thereto, said wrap sections being affixed to said rings.

15. A scroll member as claimed in claim 14, wherein said radially outer wrap section is affixed to the outermost of said rings and said radially inner wrap section is affixed to the next inwardly disposed adjacent ring.

16. A scroll member as claimed in claim 14, wherein said radially outer wrap section is affixed to the next to innermost of said rings, and said radially inner wrap section is affixed to the innermost of said rings.

17. A scroll member as claimed in claim 14, further comprising elastomeric sealing means between each of said rings and said end plate.

18. A scroll member as claimed in claim 1, wherein said actuating means comprises a motor, and means connecting said motor to said wrap sections, whereby actuation of said motor causes said wrap sections to move with respect to one another.

19. A scroll member as claimed in claim 18, wherein said motor is a fluid motor and said connecting means comprises linkage means.

20. A scroll member as claimed in claim 18, wherein said motor is connected to the outer ends of said wrap sections.

21. A scroll member as claimed in claim 18, wherein said wrap sections are moved in equal and opposite directions by said motor.

22. A scroll member as claimed in claim 1, wherein said actuating means moves said wrap sections in equal and opposite directions.

23. A scroll member as claimed in claim 1, wherein each of said wrap sections is of approximately the same thickness in the radial direction.

24. A scroll member as claimed in claim 1, in combination with a second scroll member having a second spiral wrap engaging said first-mentioned spiral wrap.

25. A combination as claimed in claim 24, wherein said second wrap has a thickness less than or equal to the total minimum thickness of said first-mentioned wrap.

26. A combination as claimed in claim 24, wherein said first mentioned scroll member is fixed and said second scroll member orbits with respect thereto.

27. A scroll member as claimed in claim 1, further comprising a plurality of nested annular circular concentric rings mounted on said end plate for rotational movement with respect thereto, said wrap sections being affixed to said rings and slidingly engaging one another along a plurality of mating bearing surfaces on each of said wrap sections, each of said bearing surfaces intersecting a plane parallel to said end plate along a circle, the center of curvature of said circle for at least one pair of said mating bearing surfaces lying on the center axis of said rings and having a radius equal to the radius of the inner periphery of the outermost of said rings.

28. In a scroll-type compressor, an improved scroll member comprising:

an end plate having a generally flat annular support surface thereon, an outer shoulder having a generally circular cylindrical concave surface thereon defining the outer periphery of said support surface, an inner shoulder having a generally circular cylindrical convex surface thereon defining the inner periphery of said support surface, said concave and convex surfaces each having a center of curvature lying on a common axis, and means defining a generally circular discharge opening extending through the center portion of said end plate within the confines of said inner shoulder;

an annular outer mounting ring supported on said support surface, said outer mounting ring being generally rectangular in cross-section and having inner and outer circular cylindrical peripheral surfaces concentric with one another and said axis, said outer peripheral surface of said outer mounting ring being in guided sliding relationship with said concave surface, one face of said outer mounting ring slidingly engaging said support surface with the opposite face thereof lying in a plane parallel to the plane of said support surface;

an annular inner mounting ring supported on said support surface, said inner mounting ring having means defining inner and outer circular cylindrical surfaces on said inner mounting ring concentric with each other and said axis.

said inner peripheral surface being disposed in guided sliding relationship with said convex surface, one face of said inner mounting ring slidingly engaging said support surface with the opposite face thereof lying in said plane parallel to the plane of said support surface;

at least one intermediate annular mounting ring supported on said support surface, said intermediate mounting ring being generally rectangular in cross-section and having inner and outer circular cylindrical peripheral surfaces concentric with one another and said axis, said inner peripheral surface of said intermediate mounting ring being in guided sliding relationship with the outer peripheral surface of the adjacent inwardly disposed mounting ring, said outer peripheral surface of said intermediate mounting ring being in guided sliding relationship with the inner peripheral surface of the adjacent outwardly disposed mounting ring, one face of said intermediate mounting ring slidingly engaging said support surface with the opposite face thereof lying in said plane parallel to the plane of said support surface;

a fluid seal disposed at the intersection of said support surface and the interface between each pair of adjacent mounting rings and at the intersection of said support surface and the interface between said inner mounting ring and said convex surface;

a spiral wrap disposed on said opposite faces of said mounting rings and having generally parallel inner and outer flank surfaces, said spiral wrap being split longitudinally into an outer wrap section having said outer flank surface and an inner wrap section having said inner flank surface, said inner wrap section having an outer surface comprising a plurality of interconnected arcuate portions, each of said arcuate portions being generally circular cylindrical in configuration and having a center of curvature lying on said axis, said outer wrap section having an inner surface comprising a plurality of interconnected arcuate portions, each of said arcuate portions being generally circular cylindrical in configuration and having a center of curvature lying on said axis, said arcuate portions on said inner wrap section slidingly engaging said arcuate portions on said outer wrap section, whereby rotation of said wrap sections relative to one another in one direction will cause said flank surfaces to move away from one another and in the opposite direction will cause said flank surfaces to move toward one another, thereby changing the effective thickness of the spiral wrap;

first means affixing said outer wrap section to said outer mounting ring and to every second mounting ring disposed radially inwardly thereof;

second means affixing said inner wrap section to the mounting ring immmediately radially inwardly of said outer mounting ring and to every second mounting ring disposed radially inwardly thereof; and actuating means connected to the outer ends of each of the wrap sections for causing said wrap sections to rotate with respect to one another to thereby change the effective thickness of said spiral wrap.

29. In a scroll-type compressor, an improved scroll member comprising:

an end plate having a generally flat annular support surface thereon, an outer shoulder having a generally circular cylindrical concave surface thereon defining the outer periphery of said support surface, an inner shoulder having a generally circular cylindrical convex surface thereon defining the inner periphery of said support surface, said concave and convex surfaces each having a center of curvature lying on a common axis, and means defining a discharge opening extending through the center portion of said end plate within the confines of said inner shoulder;

an annular outer mounting ring supported on said support surface, said outer mounting ring having inner and outer circular cylindrical peripheral surfaces concentric with one another and said axis, said outer peripheral surface of said outer mounting ring being in guided sliding relationship with said concave surface, one face of said outer mounting ring slidingly engaging said support surface an annular inner mounting ring supported on said support surface, said inner mounting ring having means defining inner and outer circular cylindrical surfaces on said inner mounting ring concentric with each other and said axis, said inner peripheral surface being disposed in guided sliding relationship with said convex surface, one face of said inner mounting ring slidingly engaging said support surface;

at least one intermediate annular mounting ring supported on said support surface, said intermediate mounting ring having inner and outer circular cylindrical peripheral surfaces concentric with one another and said axis, said inner peripheral surface of said intermediate mounting ring being in guided sliding relationship with the outer peripheral surface of the adjacent inwardly disposed mounting ring, said outer peripheral surface of said intermediate mounting ring being in guided sliding relationship with the inner peripheral surface of the adjacent outwardly disposed mounting ring, one face of said intermediate mounting ring slidingly engaging said support surface;

a spiral wrap disposed on the opposite faces of said mounting rings and having generally parallel inner and outer flank surfaces, said spiral wrap being split longitudinally into an outer wrap section having said outer flank surface and an inner wrap section having said inner flank surface, said inner wrap section having an outer surface comprising a plurality of interconnected arcuate portions, each of said arcuate portions being generally circular cylindrical in configuration and having a center of curvature lying on said axis, said outer wrap section having an inner surface comprising a plurality of interconnected arcuate portions, each of said arcuate portions being generally circular cylindrical in configuration and having a center of curvature lying on said axis, said arcuate portions on said inner wrap section slidingly engaging said arcuate portions on said outer wrap section, whereby rotation of said wrap sections relative to one another in one direction will cause said flank surfaces to move away from one another and in the opposite direction will cause said flank surfaces to move toward one another, thereby changing the effective thickness of the spiral wrap;

first means affixing said outer wrap section to said outer mounting ring and to every second mounting ring disposed radially inwardly thereof;

second means affixing said inner wrap section to the mounting ring immediately radially inwardly of said outer mounting ring and to every second mounting ring disposed radially inwardly thereof; and actuating means for causing said wrap sections to rotate with respect to one another to thereby change the effective thickness of said spiral wrap.

* * * * *